United States Patent [19]

Fukushima et al.

[11] 4,232,369

[45] Nov. 4, 1980

[54] METHOD OF CONTROLLING THE DECELERATION OF A REVERSING MILL

[75] Inventors: Shigeki Fukushima, Fuchu; Tadahiro Ohashi, Kokubunji, both of Japan

[73] Assignee: Tokyo Shibaura Denki Kabushiki Kaisha, Kawasaki, Japan

[21] Appl. No.: 929,563

[22] Filed: Jul. 31, 1978

[51] Int. Cl.[3] ..... G06F 15/46; G05B 15/00; B21B 37/00

[52] U.S. Cl. ..... 364/476; 72/11; 72/14; 364/472

[58] Field of Search ..... 364/104, 107, 300, 469, 364/472, 476; 72/10, 11, 12, 14

[56] References Cited

U.S. PATENT DOCUMENTS

| | | | |
|---|---|---|---|
| 3,136,183 | 6/1964 | Dart | 364/472 |
| 3,518,857 | 7/1970 | Hancock et al. | 364/472 |
| 3,543,548 | 12/1970 | Smith, Jr. | 364/107 |
| 3,553,992 | 1/1971 | Harbaugh | 364/472 |
| 3,651,676 | 3/1972 | Robertson | 72/12 |
| 4,106,318 | 8/1978 | Yanagimoto et al. | 364/472 X |

FOREIGN PATENT DOCUMENTS

| | | | |
|---|---|---|---|
| 46-27043 | 6/1971 | Japan | 364/472 |

*Primary Examiner*—Felix D. Gruber
*Attorney, Agent, or Firm*—Oblon, Fisher, Spivak, McClelland & Maier

[57] ABSTRACT

A method embodying this invention for controlling the deceleration of a reversing mill comprises a first step of defining a kickout distance in consideration of the bite speed at which a piece is caught by the main mill roll unit during every return roll pass of a piece-reciprocating operation and the kind of work carried out while the piece is made to rest during an interval between the respective roll passes; a second step of calculating the kickout speed to define the kickout distance; a third step of selecting that one of a plurality of piece position sensors arranged on the bite side of a main mill roll unit which takes the nearest upstream position relative to a mill deceleration-starting point in order to realize the calculated kickout speed; and a fourth step of figuring out a length of time required for the piece to move from the selected piece position sensor to the mill deceleration-starting point, thereby controlling the reversing mill so as to start the deceleration of the piece after lapse of said calculated travelling time of the piece.

11 Claims, 7 Drawing Figures

METHOD OF CONTROLLING THE DECELERATION OF A REVERSING MILL

This invention relates to a method for controlling the deceleration of a reversing mill, and more particularly to a method for calculating the kickout speed at which a piece is released from a main mill roll unit and defining a point of time at which the reversing mill is to be decelerated.

Hitherto, various processes of controlling the deceleration of a reversing mill have been proposed and carried out to elevate the efficiency of said mill. To date, however, no satisfactory process has been developed to define the kickout speed and deceleration-starting point. Therefore, the conventional roll work involved a certain amount of waste time, resulting in a decreased efficiency. Namely, the prior art system for controlling the deceleration of a reversing mill fixed a point at which a piece kicked out of a main mill roll unit was brought to rest, namely, a distance between the main mill roll unit and the rear end of the stopped piece. Regardless of the bite speed of a piece during the return roll pass, said kickout distance was determined in consideration of a sufficient distance to allow a piece to be accelerated up to the bite speed before the piece was caught by the main mill roll unit during the return roll pass and a distance long enough to enable prescribed work to be undertaken.

Since the kickout distance is thus fixed, the deceleration rate of a mill roll table for moving the kicked-out piece i.e. the deceleration rate of the kicked out piece are fixed, the kickout speed is also fixed. With the known reversing mill-controlling system, piece position sensors are provided on the bite side of the main mill roll unit above the mill roll table to ensure the fixed kickout speed. The sensor detects the point of time at which the rear end of a travelling piece passes the sensor. The running speed at said point of time is stored in a control computer. As this time, the piece ceases to be accelerated even while being still accelerated up to a prescribed rolling speed. Thus rolling is carried out at a speed falling short of said prescribed level. This rolling speed is referred to as an actual rolling speed. Thereafter, a suitable deceleration-starting point is figured out. At this point of time, the travelling piece begins to be decelerated at a prescribed rate. This deceleration-starting point means the point of time at which there is commenced such deceleration as causes the piece finally to travel at the kickout speed, that is, the speed at which the piece is removed from the main mill roll unit. The deceleration-starting point is defined by a timer whose operation is commenced by a signal issued from the piece position sensor when the rear end of the travelling piece passes said sensor. Namely, the main mill roll unit for driving the piece begins to be decelerated by a timer signal. The timer is set at a value representing the travelling time of the piece immediately before deceleration. This travelling time means a duration extending from the point at which the rear end of the travelling piece passes the sensor to that at which the piece should begin to be decelerated. Said travelling time of the piece is defined by calculating a distance covered by the travelling piece during a period extending from the deceleration-starting point to the point at which the piece is kicked out of the main mill roll unit in consideration of the above-mentioned actual rolling speed, the kickout speed and the deceleration rate of the piece. The above-mentioned travelling time of the piece at which the timer is set to define the deceleration-starting point is determined by dividing a value arrived at by subtracting the calculated travelling distance of the piece from a distance between the sensor and main mill roll unit by the actual rolling speed. Where the piece begins to be decelerated at the above-mentioned deceleration-starting point, the piece is removed from the main mill roll unit at a prescribed kickout speed and is brought to rest at a prescribed kickout distance from the main mill roll unit.

The above-mentioned prior art reversing mill-control system controls the deceleration of said mill such that the piece is set apart from the main mill roll unit at a fixed kickout distance. Therefore, the conventional reversing mill-controlling system has the drawbacks that in some cases, the kickout distance becomes unnecessarily long; the rolling time tends to be extended; the piece ceases to be accelerated when passing the piece position sensor, causing rolling to be carried out at an insufficient speed, thus consuming long rolling time, as occurs with a relatively short piece; even where rolling is carried out at an allowable highest speed, the sensor takes such a position as causes the piece to be sufficiently decelerated for the kickout, considerably elongating a distance between the sensor and main mill roll unit; where, therefore, rolling is effected at a low speed, the deceleration timer is set at relatively long time, undesirably causing the deceleration-starting time to be defined with low precision.

It is accordingly the object of this invention to provide a method of controlling the deceleration of a reversing mill which is free from the above-mentioned drawbacks of the prior art deceleration-controlling system, and defines a kickout speed at which the piece is released from the main mill roll unit and also a deceleration-starting point to realize said kickout speed, thereby minimizing rolling time and elevating productivity.

To attain the above-mentioned object, this invention provides a method of controlling the deceleration of a reversing mill, which comprises a first step of defining the kickout distance used after the preceding roll pass from a first distance required to accelerate a piece up to the bite speed at which the piece is caught by the main mill roll unit during the succeeding roll pass and a second distance between the main mill roll unit and the rest position of the piece which varies with the kind of work carried out while the piece stands at rest during an interval between the respective roll passes; a second step of calculating the kickout speed of the travelling piece required to stop it at the above-defined kickout distance; and a third step of including a process of selecting a required one from among a plurality of piece position sensors arranged along the travelling course of the piece and a process of calculating the travelling time of the piece extending from the point at which the rear end of the travelling piece is detected by a sensor to that at which the piece should begin to be decelerated, the sensor is selected from among a plurality of piece position sensors arranged along the travelling course of the piece. The reversing mill-decelerating method of this invention causes the piece to be decelerated after the above-defined travelling time, thereby accurately realizing the kickout speed defined by the second step and the kickout distance determined by the first step.

This invention has the advantages that the kickout distance of the piece can be set at as small a value as required; the deceleration-starting point can be accurately defined by calculating the travelling time of the piece extending from the point at which the rear end of the travelling piece passes the selected one of the plural piece position sensors which takes the nearest upstream position relative to the deceleration-starting point to that at which said deceleration is actually commenced; since the sensor nearest to the main mill roll unit as viewed in the upstream direction is selected, a piece can be rolled at a relatively high rate, thereby elevating the efficiency of a reversing mill.

This invention can be more fully understood from the following detailed description when taken in conjunction with the accompanying drawings, in which:

FIG. 1 schematically shows the arrangement of the main section of a reversing mill embodying this invention;

FIG. 2 indicates the speed pattern of a piece travelling through the reversing mill of FIG. 1;

Figure 4A:
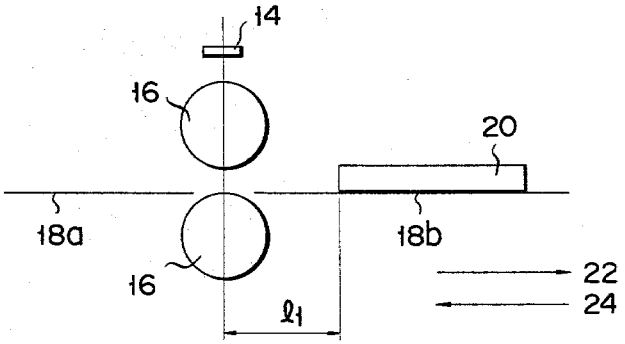
FIG. 4A illustrates the piece of FIG. 3 brought to rest after kicked out of the main mill roll.
Figure 4B:
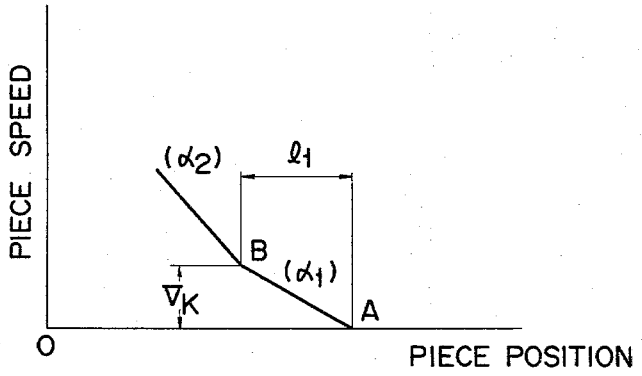
Figure 5:
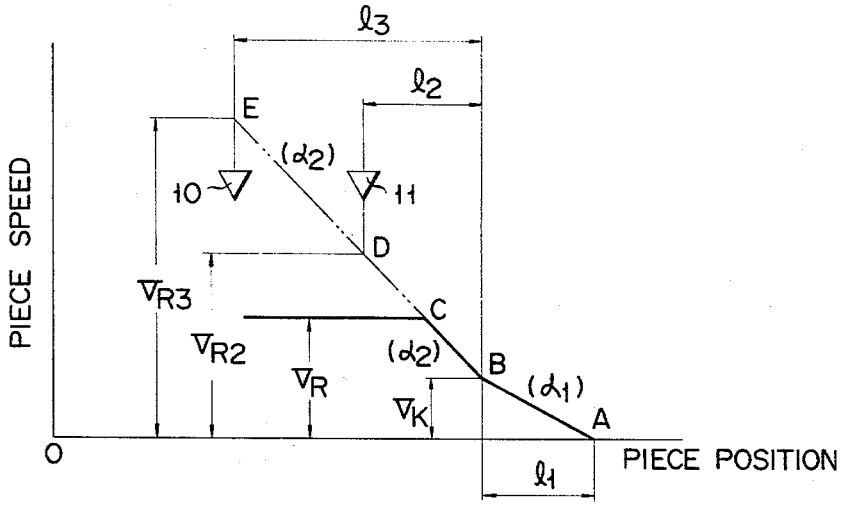
Figure 6:
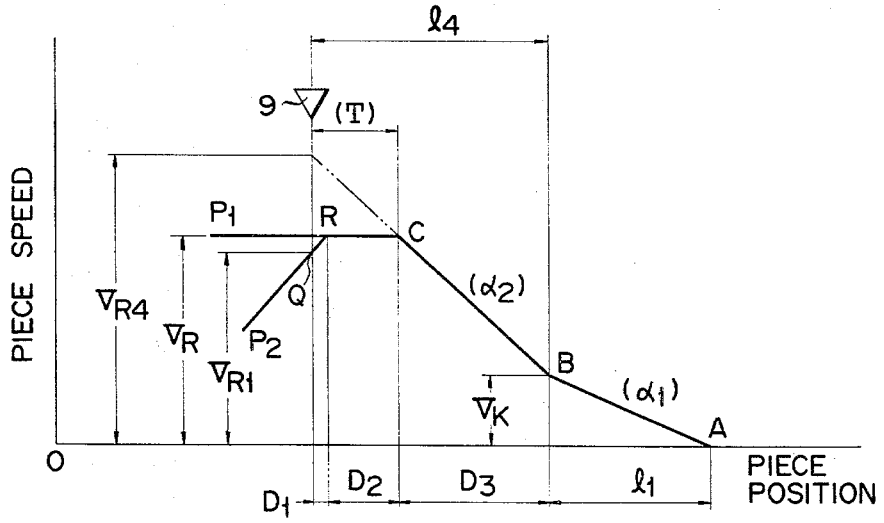

FIG. 4B indicates the manner in which the piece progressively decreases in speed up to its standstill;

FIG. 5 sets forth the process of figuring out an initial piece speed where a prescribed kickout speed is defined by commencing piece deceleration at a predetermined rate from the position of a selected piece position sensor; and FIG. 6 shows the speed pattern of a piece of FIG. 5, where it reaches a prescribed rolling speed, as well as where it does not attain said speed when it is brought to a selected piece position sensor.

Before going into the details of the method of this invention for controlling the deceleration of a reversing mill, description is first given of the arrangement of the reversing mill and the rolling process.

Figure 1:
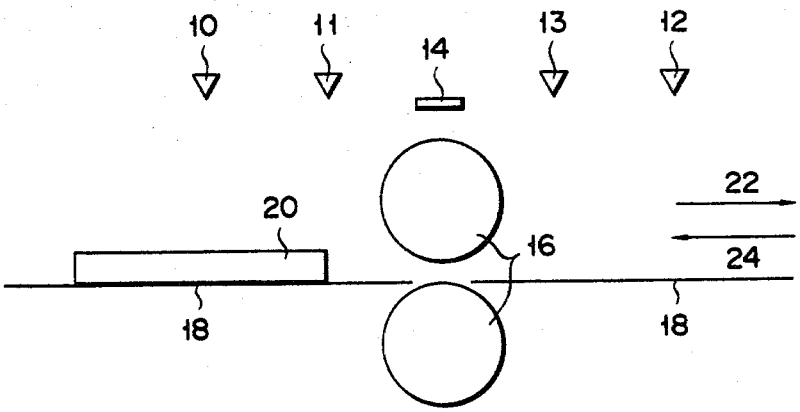
Figure 2:
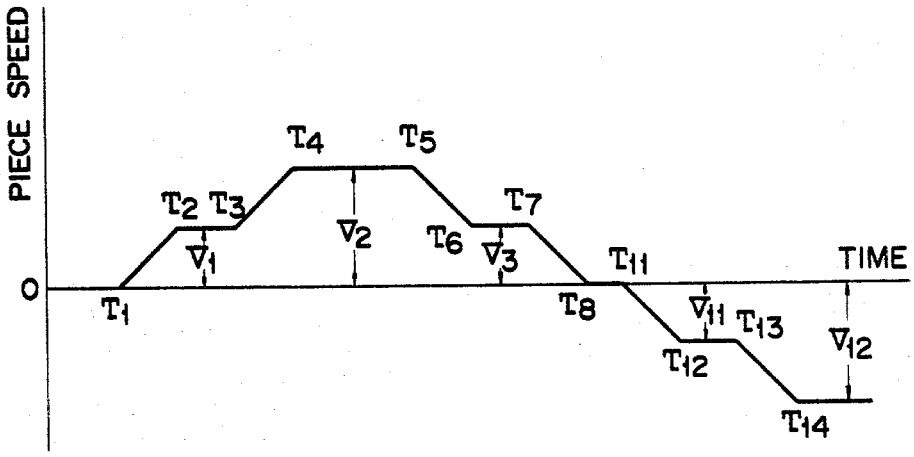

Referring to FIG. 1, referential numerals 10, 11, 12, 13 denote piece position sensors (hereinafter simply referred to as "sensors") for detecting a piece when it has arrived at a prescribed position. Referential numeral 14 represents a load cell; 16 a main mill roll unit; and 18 a mill roll table. FIG. 1 shows a piece 20 about one or two meters distant from the main mill roll unit 16 on the upstream side thereof. An arrow 22 shows the forward direction of a travelling piece, and an arrow 24 the backward direction thereof. FIG. 2 illustrates the manner in which the speed of a travelling piece changes with time when the piece is rolled by the reversing mill of FIG. 1. The ordinate shows the piece speed, and the abscissa indicates time. Referring to FIG. 2, $V_1$ represents the bite speed of the piece; $V_2$ a rolling speed preset for each roll pass according to a rolling schedule; $V_3$ a kickout speed at which the piece is released from a main mill roll; $V_{11}$ the bite speed of the piece at its return to the main mill roll unit 16; $V_{12}$ the rolling speed of the piece during said return. Since the direction of the piece movement is reversed, the characters $V_{11}$, $V_{12}$ are given below the time line.

When the reversing mill is started at a point of time $T_1$, the main mill roll unit 16 and mill roll table 18 are actuated, causing the piece 20 to be accelerated in the forward direction 22. $T_2$ denotes a point of time at which the piece 20 reaches the bite speed $V_1$. The bite speed is a predetermined travelling speed of the piece 20 at which it is caught by the main mill roll 16. The piece 20 moves at the speed $V_1$. At a point of time $T_3$, the piece 20 is caught by the main mill roll unit 16 and carried forward in the direction 22 at a rolling speed corresponding to the rotating speed of the main mill roll unit 16. When detecting the bite of the piece 20 by the mill roll unit 16, the load cell 14 sends forth a detection signal. Upon receipt of the detection signal, the main mill roll unit 16 and mill roll table 18 have the operation so controlled as to cause the piece 20 to be accelerated at a point of time $T_3$ up to the rolling speed $V_2$. At a point of time $T_4$, the piece 20 reaches the rolling speed $V_2$ to be rolled at said speed. $T_5$ represents a point of time at which the rear end of the piece 20 reaches a prescribed position while rolling procedes. This point of time $T_5$ is detected by a piece position sensor 10 or 11. At $T_5$, the piece 20 is begins to be decelerated toward the kickout speed $V_3$. $T_6$ indicates a point of time at which the piece 20 reaches the kickout speed $V_3$. $T_7$ denotes a point of time at which the rolled piece 20 is removed from the main mill roll unit 16. The removal is detected by the load cell 14. A deceleration instruction is issued to the mill roll table 18 in response to a detection signal delivered from the load cell 14. Accordingly, the mill roll table 18 and in consequence the travelling piece 20 are brought to rest at a point of time $T_8$. $T_{11}$, $T_{12}$, $T_{13}$, $T_{14}$ are points of time at which operations corresponding to those carried out at the previously mentioned points of time $T_1$, $T_2$, $T_3$, $T_4$ take place during the backward roll pass.

The variation of the piece speed shown in FIG. 2 is effected by a computer according to output signals from the later described sensor and load cell and in conformity to a rolling program. According to the method of this invention, the bite speed $V_1$ of FIG. 2 is set at a predetermined value. The piece 20 is kicked out of the main mill roll unit 16 at a speed matching the kind of work carried out during an interval between the respective roll passes while the piece 20 remains at rest.

Figure 3:
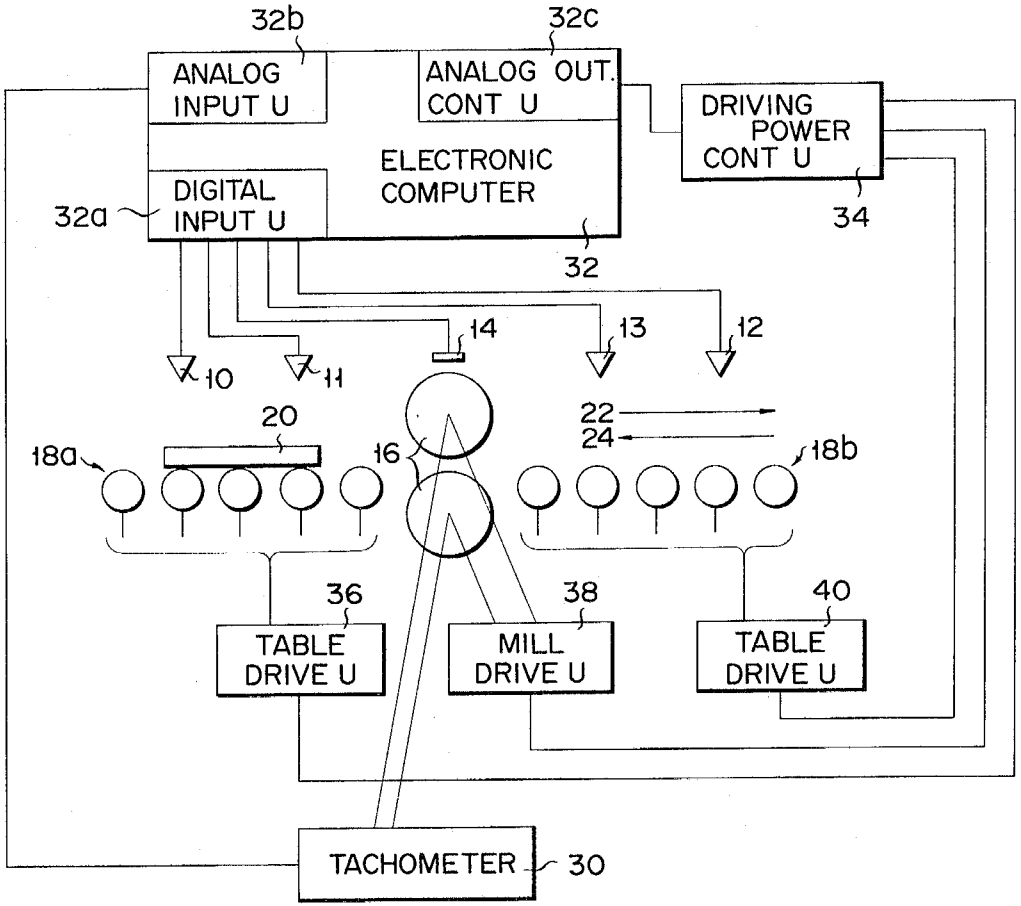
FIG. 3 is a block circuit diagram of the reversing mill of FIG. 1 including control units such as an electronic computer and driving means of motors.

FIG. 3 is a explanative representation of this invention whose arrangement and operation were briefly described in FIGS. 1 and 2. The parts of FIG. 3 the same as those of FIG. 1 are respectively denoted by the same numeral. Referential numerals 10, 11 shows a plurality (two are indicated) of piece position sensors provided on the bite side of the main mill roll unit 16 above the mill roll table **18*a*. 12, 13 represent a plurality of piece position sensors (two are indicated) disposed on the kick out side of the main mill roll unit above the mill roll table 18*b*. 14 shows a load cell for detecting the point of time at which the piece is caught by the main mill roll unit 16 and the point of time at which the piece is kicked out of the main mill roll unit 16. 30 is a tachometer for detecting the speed at which the main mill roll unit 16 is rotated. 32 is an electronic computer comprising a digital signal input unit 32*a* supplied with detection signals delivered from the sensors 10, 11, 12, 13; an analog input-receiving unit 32*b* supplied with an output signal from the tachometer 30; and an analog output control unit 32*c*. This analog output control unit 32*c* drives a mill roll table-driving unit 36 positioned on the bite side of the main mill roll unit 16, a main mill roll unit-driving means 38; and a mill roll table-driving unit 40 disposed on the kickout side of the main mill roll unit 16, all through a driving power control unit 34. Upon receipt of a speed instruction from the analog output control unit 32*c*, the driving power control unit 34 causes the abovementioned driving units 36, 38, 40** to be operated at a speed corresponding to the speed instruction.

There will now be described the deceleration-controlling method of this invention in the order of the following items (1) to (4). Description only refers to the case where the piece 20 is rolled from the left side to the right side of FIG. 3, because the same description is applicable to the rolling of the piece 20 in the opposite direction.

(1) A method of defining the kickout distance of the piece 20

The first requisite for shortening the rolling time of the piece 20 is to reduce the kickout distance. FIG. 4A shows the piece 20 which is kicked out of the main mill roll unit 16 to the right side and brought to rest. $l_1$ denotes the kickout distance. This kickout distance $l_1$ is generally set at a value equal to a maximum one among the later described distances $l_{1A}$ to $l_{1Z}$. The distance $l_{1A}$ is expressed by the following equation:

$$l_{1A}=(V_{Ne}^2/2\alpha_1) \quad (1)$$

where:

$V_{NE}$=the bite speed at which the piece 20 is conducted to the main mill roll unit 16 during the return roll pass, and also the bite speed at which the piece is carried to the main mill roll unit 16 by the mill roll table $\alpha_1$=the acceleration rate of the mill roll table and in consequence the piece 20

FIG. 4A denotes the case where the piece 20 is going to be forwarded to the left side.

$l_{1B}$=a distance where no work is carried out during an interval between the respective roll passes while the piece 20 stands at rest $l_{1C}$=a distance where work A is undertaken during said interval $l_{1D}$=a distance where work B is conducted during said interval

⋮ ⋮

$l_{1Z}$=a distance where work Z is performed during said interval

The work A is, for example, to cause the rollpressing unit of the reversing mill to adjust the interroll spaced for the return roll pass of the piece. The work B is to applying a tilting process to the piece 20. The work C is to descale the piece 20. These works A to Z are to carry out operations required for the reversing mill and accessary units for each roll pass, and are applied to the piece 20 in combination. At this time, selection is obviously made of the largest kickout distance from among those of the above listed ones $l_{1A}$ to $l_{1Z}$ which related to the works actually carried out.

The distance $l_{1A}$ is calculated from the previously described equation (1). $l_{1B}$ to $l_{1Z}$ are predetermined distances and stored in the electronic computer 32. The kickout distances selected by the electronic computer 32 according to said predetermined values are those which are actually used in the deceleration-controlling method of this invention. These predetermined values represent the shortest possible kickout distance required for the respective works.

(2) A method of determining the kickout speed of the piece 20

After the kickout distance is defined as described above, the kickout speed $V_K$ corresponding to said kickout distance is derived from the following equation relative to the kickout distance $l_1$:

$$l_1=\frac{V_K2}{2\alpha_1}+V_K\cdot td_1$$

where:

$V_k$=the kickout speed $\alpha_1$=the deceleration rate of the mill roll table, or the piece 20. (According to this embodiment, $\alpha_1$ is taken to have the same value as the acceleration rate $\alpha_1$ of the previously described equation (1).)

$td_1$=a response time of the electronic computer 32 (FIG. 3) and other mechanical units operated by an instruction from said electronic computer 32

FIG. 4B illustrates the manner in which the piece 20 is progressively decelerated during the period extending from the point at which the piece 20 removed from the main mill roll unit 16 at the kickout speed $V_K$ in the forward direction 22 begins to be decelerated at the rate $\alpha_1$ to the point at which the kicked out piece 20 is brought to rest at the kickout distance $l_1$. The ordinate shows the forward kickout speed of the piece 20 and the abscissa indicates the position of the rear end of the piece 20. Point A shows the position of the rear end of the piece 20 when brought to rest. Point B indicates the position of the rear end of the piece just kicked out of the main mill roll unit 16. $V_K$ is the kickout speed.

The first term of the right side of the previously described equation $l_1=(V_K2/2\alpha_1)+V_K\cdot td_1$ denotes a distance covered by the piece 20 travelling at the kickout speed $V_K$ during the period extending from the point at which the piece 20 begins to be decelerated at the rate $\alpha_1$ to the point at which the piece 20 is brought to rest. In this case, $td_1$ is taken to be zero. (The deceleration rate given in the speed pattern is enclosed in parenthesis. The same applies to be following drawings.) The second term of the left side of the above equation represents a distance covered by the piece 20 during the response time. Derived from the above equation is the following quadratic equation relative to the kickout speed $V_K$.

$$V_K2+2\alpha_1\cdot td_1\cdot V_K-2\alpha_1 l_1=0$$

Therefore, $$V_K=\frac{-2\alpha_1\cdot td_1\pm\sqrt{(2\alpha_1\cdot td_1)^2+8\alpha_1 l_1}}{2}$$

of the $V_K$ values obtainable from the above equation, a practically applicable value $V_K\leqq 0$ is expressed as follows $$V_K=\sqrt{2\alpha_1\cdot l_1+(\alpha_1\cdot td_1)^2}-\alpha_1\cdot td_1 \quad (2)$$

(3) Selection of a required one from among a plurality of piece position sensors FIG. 5 sets forth a speed pattern of the piece 20 similar to that of FIG. 4B. Referring to FIG. 5, the piece 20 is rolled at a speed $V_R$. When the rear end of the piece 20 reaches a point C or deceleration-starting point, the piece 20 begins to be decelerated at a prescribed rate $\alpha_2$. When the rear end of the piece 20 arrives at a point B, namely, when the piece 20 is kicked out of the main mill roll unit 16, the piece 20 travels at the kickout speed $V_K$. Later the piece 20 is decelerated at a prescribed rate $\alpha_1$, and the rear end thereof rests at the kickout distance $l_1$.

Referential numerals 10, 11 of FIG. 5 are piece position sensors. $l_2$, $l_3$ respectively denote a distance between the main mill roll unit 16 and sensor 11, and a distance between the main mill roll unit 16 and sensor 10.

For speed control by the process of FIG. 5, it is necessary to find the point of time at which the rear end of the piece 20 reaches a point C, namely, a deceleration-starting point. This deceleration-starting point is defined as follows. First, the point at which the rear end of the piece 20 passes the sensor 10 or 11 is detected by said sensor. Calculation is made of a period of time extending from the point at which the rear end of the piece 20 is detected by the sensor to the point at which the piece 20 reaches the point C at the rolling speed $V_R$. A timer actuated at the detection of the rear end of the piece 20 is set at the above-mentioned calculated period of time. The point at which the timer begins to be operated is taken as the point at which the rear end of the piece 20 has reached the point C. At this time, the piece 20 begins to be decelerated at the rate $\alpha_2$. Where, in this case, the piece position sensor 10 is selected for detection of the piece position, then the timer is set at a value representing an interval lying between the point at which the rear end of the piece 20 is detected by the sensor 10 and the point at which deceleration is started, namely, a length of time required for the piece 20 to travel at the rolling speed $V_R$ from the sensor 10 to the deceleration-starting point C. Where the piece position sensor 11 is used, then the timer is set at a value denoting a smaller interval extending from the point at which the rear end of the piece 20 is detected to the point at which the piece 20 reaches the deceleration-starting point C by travelling at the rolling speed $V_R$. A shorter interval at which the timer is set is preferred in elevating rolling efficiency. The reason is that a longer timer interval increases a period of time lying between the point at which the rear end of the piece 20 is detected by the sensor and the point at which deceleration actually starts; and the deceleration-starting point C tends to be inaccurately defined due to the rolling speed possibly changing during said longer timer interval and erros occurring in the detection of the rolling speed of the main mill roll unit 16 by the tachometer 30.

There will now be described a practical process of selecting such piece position sensor as enables a timer to be set at a value showing a minimum interval. For this selection, calculation is made for each sensor of the optimum travelling speed of the piece which provides the kickout speed $V_K$ when the piece 20 has its rear end detected by the sensor and begins to be decelerated at the rate of $\alpha_2$, namely when the rear end is kicked out of the main mill roll unit 16. With respect to the sensor 11 of FIG. 5, the point at which the abovedefined optimum travelling speed $V_{R2}$ of the piece 20 is realized is represented by an intersection D between an extension in the direction BC of a linear section CB denoting progressive deceleration at the rate of $\alpha_2$ and a line passing the sensor 11 in parallel to the ordinate. The optimum travelling speed $V_{R3}$ of the piece 20 for the sensor 10 is denoted by an intersection E. However, it is necessary to take response delays into account in connection with the above-mentioned optimum travelling speeds $V_{R2}$, $V_{R3}$ of the piece 20.

The optimum travelling speed $V_{R2}$ of the piece 20 relative to the sensor 11 is calculated from the following equation:

$$\frac{l_2}{1-\rho} = \frac{V_{R2}2 - V_K2}{2\alpha_2} + V_{R2} \cdot td_2$$

where:

$l_2$=a distance between the sensor 11 and main mill roll unit 16

$td_2$=response time of an electronic computer and associated units $\rho$=a draft compensation coefficient first term of the right side of the above equation=a distance covered by the piece 20 during a period of time in which it is decelerated from $V_{R2}$ to $V_K$ second term of the left side of the above equation=a distance covered by the piece 20 travelling for a length of time $td_2$ at the speed $V_{R2}$ The above equation may be modified into the following quadratic equation relative to $V_{R2}$:

$$V_{R2}2 + 2\alpha_2 \cdot td_2 \cdot V_{R2} - \left(\frac{2\alpha_2 \cdot l_2}{1-\rho} + V_K2\right) = 0$$

Therefore, $$V_{R2} = \frac{1}{2}\left[-2\alpha_2 \cdot td_2 \pm \sqrt{4(\alpha_2 \cdot td_2)^2 + \left(\frac{8\alpha_2 \cdot l_2}{1-\rho}\right) + 4V_K2}\right]$$

The positive value of $V_{R2}$ derived from the above equation is expressed as follows:

$$V_{R2} = \sqrt{(\alpha_2 \cdot td_2)^2 + \frac{2\alpha_2 \cdot l_2}{1-\rho} + V_K2} - \alpha_2 \cdot td_2 \quad (3)$$

where:

$\alpha_2$, $td_2$=predetermined values $\rho$=a draft compensation coefficient (a value varying with a rolling schedule)

Where an equation $V_{R2} \leqq V_R$ results from comparison between the rolling speed $V_R$ of the piece 20 according to the rolling schedule and the travelling speed $V_{R2}$ thereof calculated from the above equation, then the rolling speed $V_R$ is greater than a maximum travelling speed of the piece 20 which begins to be decelerated along the prescribed curve CBA, starting with the sensor 11. Therefore, it is impossible to use a timer in connection with the sensor 11, making it necessary to control the deceleration of the piece 20 in connection with the sensor 10 more distant from the main mill roll unit 16 than the sensor 11.

The foregoing description refers to the case where only two sensors 10, 11 are used. Where, however, a large number of sensors are provided, it is advised to calculate for each sensor a maximum travelling speed of the piece 20 which is later decelerated and select that sensor which enables said maximum travelling speed of the piece 20 to be higher than the prescribed rolling speed and is disposed nearest to the main mill roll unit 16 on the upstream side thereof, namely, allows a timer to be set at a value denoting the shortest possible interval.

Where the piece 20 is rolled, using a sensor thus selected, a relatively high rolling speed can be designed.

Where the piece 20 is short, its rear end reaches the selected sensor relatively soon while the piece is accelerated, thereby eliminating the drawback of the prior art deceleration-controlling method that acceleration of the piece 20 is suspended as previously mentioned and the piece 20 is rolled at the resultant slow speed. Therefore, the method of this invention is effective to elevate rolling efficiency.

(4) Calculation of a length of time at which a timer is set

FIG. 6 shows, like FIG. 5, the manner in which the travelling speed of the piece 20 is progressively decelerated. Referential numeral 9 denotes a piece position sensor selected by the process described under the preceding item (3). The travelling speed of the piece 20 is equal to the surface speed of the mill roll table and main mill roll unit 16 for driving the piece 20. Actually, it is unnecessary to consider the effect of the slip of the mill roll table 18 and main mill roll unit 16 relative to the piece 20 on its travelling speed. Therefore, said slip is disregarded in figuring out a length of time at which a timer is set.

Referring to FIG. 6, $P_1-R-C$ denotes a distance through which the rear end of the piece 20 travels at the rolling speed $V_R$. C is a point at which the timer actuated when the rear end of the piece 20 reaches a sensor 9 counts length of time T at which said timer is set, and generates an output signal, causing the deceleration of the piece 20 to be commenced at the rate of $\alpha_2$. CBA denotes, like that of FIG. 5, a region of deceleration. $D_2$ shows a distance between the points R and C; and $D_3$ a distance between the points C and B. $P_2-Q-R$ represents a region in which the travelling speed $V_{R1}$ of the piece 20 whose rear end has passed the sensor 9 at a point Q still falls short of the prescribed level $V_R$ and continues to be increased until said prescribed speed $V_R$ is reached at a point R. $D_1$ is a distance covered by the piece 20 while its speed is accelerated from $V_{R1}$ at the point Q corresponding to the position of the sensor 9 to $V_R$ at the point R. With the foregoing embodiment, acceleration during the interval from $P_2$ to Q is carried out at the same rate $\alpha_2$ as that at which the piece is decelerated while travelling from the point C to the point B.

There will now be described the case where the rear end of the piece 20 passes the sensor 9 at a speed of $V_{R1}$. This travelling speed $V_{R1}$ is measured by the rotation speed tachometer 30 of FIG. 3 and is stored in an electronic computer 32. Where the travelling speed $V_{R1}$ is equal to the prescribed rolling speed $V_R$, namely, where the piece 20 has been fully accelerated, a length of time T at which a timer is set is calculated from the following equation:

$$\frac{l_4}{1-\rho} = \frac{V_R2 - V_K2}{2\alpha_2} + (T + td_2)V_{R1}$$

The first term of the right side of the above equation is a distance previously indicated by $D_3$. The second term denotes a distance corresponding to $(D_1+D_2)$. As seen from FIG. 6, $l_4$ represents a sum of these distance $D_1$, $D_2$, $D_3$. The set time T of the timer which is unrelated to the coordinate system of FIG. 6 is enclosed in a parenthesis.

The above-mentioned set time T of the timer can be determined from the following equation (4) rearranged from the above equation.

$$T = \frac{\dfrac{l_4}{1-\rho} - \dfrac{V_R2 - V_K2}{2\alpha_2}}{V_R} - td_2 \qquad (4)$$

In case of $V_{R1} < V_R \leqq V_{R4}$ ($V_{R4}$ denotes the travelling speed of the piece 20 which begins to be decelerated at the rate of $\alpha_2$ from the position of the sensor 9 and later progressively decreases along the C-B line of FIG. 6), namely while the piece 20 is accelerated, the set time of the timer is calculated from the following equation:

$$\frac{l_4}{1-\rho} = \frac{V_R2 - V_K2}{2\alpha_2} + \frac{V_R2 - V_{R1}2}{2\alpha_2} + ((T + td_2) - \frac{V_R - V_{R1}}{\alpha_2}) \cdot V_R$$

The first term of the right side of the above equation denotes the distance $D_3$; the second term the distance $D_1$; the third term the distance $$D_2 \cdot \frac{V_R - V_{R1}}{\alpha_2}$$

included in the third term represents a length of time required for the rear end of the piece 20 to travel from the point Q to the point R. A difference between $(T+td_2)$ and the time required for the piece 20 to cover said Q-R distance shows a length of time required for the rear end of the piece 20 to be carried from the point R to the point C. As apparent from the foregoing description, the right side of the above equation indicates a sum of the distances $D_1$, $D_2$, $D_3$, which is represented by $l_4$. The set time T of the timer is determined from the following equation (5) modified from the above equation:

$$T = \frac{\dfrac{l_4}{1-\rho} - \dfrac{V_R2 - V_{R1}2}{2\alpha_2} - \dfrac{V_R2 - V_K2}{2\alpha_2}}{V_{R1}} + \frac{V_R - V_{R1}}{\alpha_2} - td_2 \qquad (5)$$

The above equations (4), (5) enable the prescribed length of time at which the timer is set relative to a selected sensor 9 to be easily figured out.

An electronic computer carries out calculation of the kickout distance, calculation of the kickout speed, selection of a sensor, and calculation of a length of time at which the timer is set relative to the selected sensor all intended for the speed control of a reversing mill.

A reversing mill whose speed is controlled as described above by the method of this invention carries out rolling work with a minimum kickout distance and in consequence at a higher rolling speed than in the case where the method of the invention is not applied, thereby shortening rolling time and elevating rolling efficiency.

What we claim is:

1. A system for controlling the deceleration of a reversing mill, comprising:

reversible main mill rolls for rolling a piece;

a pair of roller tables provided on both sides of said main mill rolls and along the path of said main mill rolls for moving said piece;

drive means for driving said main mill rolls and said roller tables;

a plurality of piece position sensors arranged on both sides of said main mill rolls and along said roller tables for detecting the position of said piece and for generating a detection signal;

load cell means for generating a signal when said piece is bitten by said main mill rolls and when said piece is released from said main mill rolls; and control means for controlling said drive means;

wherein said control means actuates said drive means so as to accelerate said piece up to a predetermined bite speed, to start accelerating said piece up to a predetermined rolling speed in response to a detection signal of said load cell means representing that said piece is bitten by said main mill rolls, and to start deceleration said piece down to a predetermined kickout speed at a predetermined rate when said piece reaches a predetermined deceleration starting point from a position where it has been detected by a selected one of said piece position sensors which are arranged on the piece feed side of said main mill rolls, said selected hot piece detector being located nearer to said deceleration starting point than the other detectors and farther from said main mill rolls than said deceleration starting point, said deceleration starting point being determined such that said piece is decelerated down to the predetermined kickout speed the moment it is released from said main mill rolls, said deceleration starting point being located at a point where said piece exists upon the lapse of a period of time derived from said rolling speed and the distance between said selected piece position sensor and said deceleration starting point and set in a timer which starts in response to the detection signal from said selected piece position sensor, whereby the moment said piece is released from said main mill rolls, deceleration at a predetermined rate is started on said piece in response to an output signal of said load cell means thereby to stop said piece after it has traveled a predetermined kickout distance.

2. The system according to claim 1, wherein:

said piece is accelerated for said kickout distance up to the bite speed used in the next roll pass, and said kickout distance is determined by a first distance determined by a pass schedule and a second distance $l_{IA}$ obtained by the following equation:

$$l_{IA}=(V_{NE})^2/2\alpha_1$$

where $V_{NE}$ is the bite speed in the next roll pass, and $\alpha_1$ is the rate at which the piece is accelerated to $V_{NE}$.

3. The system according to claim 2, wherein:

said kickout speed $V_K$ is obtained by the following equation:

$$V_K = \sqrt{2\alpha_1 \cdot l_1 + (\alpha_1 \cdot td_1)^2} - \alpha_1 \cdot td_1$$

where $l_1$ is the kickout distance, $td_1$ is the sum of the response delays of said control means and said drive means used to control the deceleration of the piece.

4. The system according to claim 3, wherein:

said selected piece position sensor has a value $V_{R2}$ which is smaller than those of the other piece position sensors and larger than the rolling speed, said $V_{R2}$ being obtained by the following equation:

$$V_{R2} = \sqrt{(\alpha_2 \cdot td_2)^2 + \frac{2\alpha_2 \cdot l_2}{1-\rho} + V_K^2} - \alpha_2 \cdot td^2$$

where $l_2$ is the distance between each piece position sensor and said main mill rolls, $\alpha_2$ is the rate at which the piece is decelerated from said rolling speed down to said kickout speed $V_K$, p is a draft compensation coefficient, and $td_2$ is the sum of response delays of said control means and said drive means.

5. The system according to claim 4, wherein:

said period of time T to be set in said timer is obtained by the following equation:

$$T = \frac{\frac{l_4}{1-\rho} - \frac{V_R^2 - V_{R1}^2}{2\alpha_2} - \frac{V_R^2 - V_K^2}{2\alpha_2}}{V_{R1}} + \frac{V_R - V_{R1}}{\alpha_2} - td_2$$

where $l_4$ is the distance between said selected piece position sensor and said main mill rolls, $V_R$ is said rolling speed, and $V_{R1}$ is the speed at which said piece is traveling when it is detected by said selected piece position sensor.

6. A method for controlling the deceleration of a reversing mill having reversible main mill rolls for rolling a piece, a pair of roller tables provided on both sides of said main mill rolls and along the path of said main mill rolls for moving said piece, drive means for driving said main mill rolls and said roller tables, a plurality of piece position sensors arranged on both sides of said main mill rolls and along said roller tables for detecting the position of said piece and for generating a detection signal, load cell means for generating a signal when said piece is bitten by said main mill rolls and when said piece is released from said main mill rolls, and control means for controlling said drive means, wherein said method comprises the steps of:

accelerating said piece on said roller tables up to a predetermined bite speed and causing said piece to travel at said bite speed;

accelerating said piece up to a predetermined rolling speed, starting when said piece is bitten by said main mill rolls, and causing said piece to travel at said predetermined rolling speed;

decelerating said piece at a predetermined deceleration rate, starting when said piece reaches a deceleration-starting point so that said piece is released from said main mill rolls at a predetermined kickout speed; and decelerating said piece released from said main mill rolls at another rate so as to stop said piece after said piece has traveled a predetermined kickout distance.

7. The method according to claim 6, wherein said kickout speed $V_K$ is determined from the following equation:

$$V_K = \sqrt{2\alpha_1 \cdot l_1 + (\alpha_1 \cdot td_1)^2} - \alpha_1 \cdot td_1$$

where:

$l_1$ = the kickout distance $td_1$ = response time of a means for calculating $l_1$ and associated units used in controlling the speed of the reversing mill.

8. The method according to claim 6, wherein:

said kickout distance is a longer one of a first distance which is determined by a pass schedule and a second distance $l_{1A}$ which is necessary to accelerate the piece up to a bite speed used in the next roll pass and which is obtained by the following equation:

$$l_{1A} = (V_{NE})^2/2\alpha_1$$

where $V_{NE}$ is the bite speed in the next roll pass, and $\alpha_1$ is the rate at which the piece is accelerated to $V_{NE}$.

9. The method according to claim 6, wherein:

said piece reaches said deceleration starting point upon the lapse of a period of time set in a timer and derived from said rolling speed and the distance between one of said piece position sensors and said deceleration starting point, said timer being designed to start in response to an output signal of one of said piece position sensors arranged along a travelling path of said piece.

10. The method according to claim 9, wherein selection is made of said one of said plurality of piece position sensors arranged on the bite side of the main mill roll unit which enables the piece to travel at an optimum speed $V_{R2}$ which is higher than the rolling speed as compared with the values of the travelling speed $V_{R2}$ calculated from the following equation with respect to said plural piece position sensors and yet the smallest value among said calculated values of $V_{R2}$ $$V_{R2} = \sqrt{(\alpha_2 \cdot td_2)^2 + \frac{2\alpha_2 \cdot l_2}{1-\rho} + V_K^2 - \alpha_2 \cdot td^2}$$

where:

$l_2$ = a distance between the main mill roll unit and the respective piece position sensors $\alpha_2$ = the rate at which the piece is decelerated from the rolling speed to the kickout speed $V_K$ $td_2$ = response time of an electronic computer and associated units used in controlling the speed of the reversing mill $\rho$ = a draft compensation coefficient.

11. The method according to claim 10, wherein the period of time to be set in said timer is calculated from the following equation with respect to the selected piece position sensor:

$$T = \frac{\frac{l_4}{1-\rho} - \frac{V_R^2 - V_{R1}^2}{2\alpha_2} - \frac{V_R^2 - V_K^2}{2\alpha_2}}{V_{R1}} + \frac{V_R - V_{R1}}{\alpha_2} - td_2$$

where:

$l_4$ = a distance between the main mill roll unit and the selected piece position sensor $V_R$ = a rolling speed $V_{R1}$ = the travelling speed of the piece when its position is detected by said selected piece position sensor.

* * * * *

UNITED STATES PATENT AND TRADEMARK OFFICE

CERTIFICATE OF CORRECTION

PATENT NO. : 4,232,369

DATED : NOVEMBER 4, 1980

INVENTOR(S) : SHIGEKI FUKUSHIMA et al

It is certified that error appears in the above—identified patent and that said Letters Patent is hereby corrected as shown below:

Column 11, line 59 the equation should read as follows:

-- $V_K = \sqrt{2\alpha_1 \cdot \ell_1 + (\alpha_1 \cdot td_1)^2} - \alpha_1 \cdot td_1$--.

Column 12, top of page the equation should read as follows:

$V_{R2} = \sqrt{(\alpha_2 \cdot td_2)^2 + \frac{2\alpha_2 \cdot \ell_2}{1 - \rho} + V_K{}^2} - \alpha_2 \cdot td_2$--.

Column 12, line 9 delete "$V_K$, p" and insert --$V_K, \rho$ --.

Column 12, line 65 the equation should read as follows:

$V_K = \sqrt{2\alpha_1 \cdot \ell_1 + (\alpha_1 \cdot td_1)^2} - \alpha_1 \cdot td_1$

UNITED STATES PATENT AND TRADEMARK OFFICE

CERTIFICATE OF CORRECTION

PATENT NO. : 4,232,369

DATED : NOVEMBER 4, 1980

INVENTOR(S) : SHIGEKI FUKUSHIMA et al

It is certified that error appears in the above-identified patent and that said Letters Patent are hereby corrected as shown below:

Column 14, top of page the equation should read as follows:

$$--V_{R2} = \sqrt{(\alpha 2 \cdot td_2)^2 + \frac{2\alpha_2 \cdot \ell_2}{1 - \rho} + V_K{}^2 - \alpha_2 \cdot td_2}--.$$

Signed and Sealed this

*Eighteenth* Day of *August 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,232,369

DATED : NOVEMBER 4, 1980

INVENTOR(S) : SHIGEKI FUKUSHIMA ET AL

It is certified that error appears in the above-identified patent and that said Letters Patent are hereby corrected as shown below:

Column 6, line 54 please delete "$V_k \leqq 0$" and insert --$V_k \geqq 0$--.

Signed and Sealed this

Sixth Day of October 1981

[SEAL]

Attest:

GERALD J. MOSSINGHOFF

Attesting Officer

Commissioner of Patents and Trademarks